US005726694A

United States Patent [19]

Kimura et al.

[11] Patent Number: 5,726,694

[45] Date of Patent: Mar. 10, 1998

[54] PRINT HEAD IN POWDER JET IMAGE FORMING APPARATUS

[75] Inventors: Takahiko Kimura; Osamu Takemura; Atsushi Fujii, all of Osaka, Japan

[73] Assignee: Mita Industrial Co., Ltd., Osaka, Japan

[21] Appl. No.: 520,006

[22] Filed: Aug. 28, 1995

[30] Foreign Application Priority Data

Sep. 30, 1994 [JP] Japan ..... 6-236689

[51] Int. Cl.[6] ..... H04H 1/40

[52] U.S. Cl. ..... 347/55

[58] Field of Search ..... 358/283–293, 358/298, 75–78

[56] References Cited

U.S. PATENT DOCUMENTS 4,814,886 3/1989 Kuge et al. ..... 358/293

*Primary Examiner*—Aditya Krishnan

*Attorney, Agent, or Firm*—Beveridge, DeGrandi, Weilacher & Young, LLP

[57] ABSTRACT

The present invention relates to a print head in a powder jet image forming apparatus comprising a plurality of first electrodes formed on the surface of an insulating layer on the side of a developer supplying roller and a plurality of second electrodes formed on the surface of the insulating layer on the side of a paper conveying section, a developer through-hole being provided at each of intersections of the first electrodes and the second electrodes. In the present invention, one or a plurality of guard electrodes for drawing a developer from the developer supplying roller and supplying the developer to the first electrodes are provided around the first electrodes on the surface of the insulating layer.

16 Claims, 10 Drawing Sheets

PRINT HEAD IN POWDER JET IMAGE FORMING APPARATUS

BACKGROUND OF THE INVENTION

1. Field of the Invention

The present invention relates to a print head in a powder jet image forming apparatus.

2. Description of the Prior Art

The applicant of the present invention has already developed a powder jet image forming apparatus as shown in FIG. 10. The powder jet image forming apparatus comprises a print head 2 for controlling the passage of toner charged to predetermined polarity, for example, negative polarity, a toner supplying roller 1 for supplying toner to the print head 2, a paper conveying roller 3 for introducing paper P to the print head 2, and a fixing roller 4 for fixing to the paper P toner transferred to the paper P.

The print head 2 comprises an insulating substrate 20, a plurality of first electrodes 21 formed on the surface of the insulating substrate 20 on the side of the toner supplying roller 1, and a plurality of second electrodes 22 formed on the surface of the insulating substrate 20 on the side of the paper conveying roller 3. The plurality of first electrodes 21 and the plurality of second electrodes 22 constitute a matrix-shaped electrode. A toner through-hole 23 penetrating the print head 2 is provided at each of intersections of the first electrodes 21 and the second electrodes 22.

An ON voltage (for example, −100 V) and an OFF voltage (for example, +300 V) are selectively applied to each of the first electrodes 21. An ON voltage (for example, 0 V) and an OFF voltage (for example, −200 V) are selectively applied to each of the second electrodes 22. FIG. 3 shows the change of voltages V1–0 to V1–7 applied to the respective first electrodes 21. As shown in FIG. 3, the first electrodes 21 are dynamically scanned, so that the applied voltages are successively turned on at predetermined unit time intervals. Only when the applied voltages of both the first electrode 21 and the second electrode 22 are ON voltages, toner passes through the toner through-hole 23 at the intersection of the first and second electrodes 21 and 22, to do dot printing.

The paper P is conveyed by the paper conveying roller 3 in a direction at right angles to the first electrodes 21 and a direction in which control by the dynamic scanning of the first electrodes 21 proceeds (a direction indicated by an arrow A in FIG. 11). A voltage of +500 V is applied to the paper conveying roller 3. The toner supplying roller 1 is grounded, and its surface potential is 0 V.

A ultrasonic vibrator 5 for ultrasonically vibrating the print head 2 to prevent the toner through-hole 23 from being clogged with toner is attached to the print head 2.

The toner is supplied to the print head 2 from the toner supplying roller 1 by the function of an electric field (an electric field for supplying toner) produced by the difference between the potential of the toner supplying roller 1 and the potential of the first electrode 21 at the time of the OFF voltage. Since a portion where the first electrodes 21 are formed is smaller than the toner supplying roller 1, however, toner cannot be efficiently supplied to the first electrodes 21 from the toner supplying roller 1, resulting in a decreased image density.

SUMMARY OF THE INVENTION

An object of the present invention is to provide a print head in a powder jet image forming apparatus capable of increasing the image density to do high-speed printing.

In a print head in a powder jet image forming apparatus comprising a plurality of first electrodes formed on the surface of an insulating layer on the side of a developer supplying roller and a plurality of second electrodes formed on the surface of the insulating layer on the side of a paper conveying section, a developer through-hole being provided at each of intersections of the first electrodes and the second electrodes, a print head in a powder jet image forming apparatus according to the present invention is characterized in that one or a plurality of guard electrodes for drawing a developer from the developer supplying roller and supplying the developer to the first electrodes are provided around the first electrodes on the surface of the insulating layer.

In the print head in the powder jet image forming apparatus according to the present invention, one or a plurality of guard electrodes for drawing a developer from the developer supplying roller and supplying the developer to the first electrodes are provided around the first electrodes on the surface of the insulating layer, whereby the developer can be efficiently supplied to the first electrodes from the developer supplying roller, thereby to make it possible to increase the density. Consequently, it is possible to do high-speed printing.

A periodic voltage taking two values, that is, an H level voltage VgH and an L level voltage VgL is applied to the guard electrode. Letting Vs be the average potential of the developer supplying roller and Vu be the average potential of the first electrode, the H level voltage VgH and the L level voltage VgL of the periodic voltage applied to the guard electrode are so set as to satisfy the conditions of $Vs<VgH$ and $Vu>VgL$ when the developer is charged to negative polarity, while being so set as to satisfy the conditions of $Vs>VgH$ and $Vu<VgL$ when the developer is charged to positive polarity.

When a plurality of guard electrodes are provided with spacing from the inside to the outside around the first electrodes on the surface of the insulating layer, there are the following methods (I) and (II), for example, as a method of setting the periodic voltage applied to each of the guard electrodes:

(I) Description is now made of the method (I) by separating a case where the developer is charged to negative polarity and a case where the developer is charged to positive polarity.

(i) In a case where the developer is charged to negative polarity

Letting Vs be the average potential of the developer supplying roller and Vu be the average potential of the first electrode, the H level voltage VgH and the L level voltage VgL of the periodic voltage applied to each of the guard electrodes are so set as to satisfy the conditions of $Vs<VgH$ and $Vu>VgL$. In addition, the H level voltages VgH of the periodic voltages respectively applied to the adjacent guard electrodes are so set that they are the same or the H level voltage VgH corresponding to the outer guard electrode is higher. Further, the L level voltages VgL of the periodic voltages respectively applied to the adjacent guard electrodes are so set that the L level voltage VgL corresponding to the outer guard electrode is lower.

(ii) In a case where the developer is charged to positive polarity

The H level voltage VgH and the L level voltage VgL of the periodic voltage applied to each of the guard electrodes are so set as to satisfy the conditions of $Vs>VgH$ and $Vu<VgL$. In addition, the H level voltages VgH of the periodic voltages respectively applied to the adjacent guard electrodes are so set that they are the same or the H level voltage VgH corresponding to the outer guard electrode is lower. Further, the L level voltages VgL of the periodic voltages respectively applied to the adjacent guard electrodes are so set that the L level voltage VgL corresponding to the outer guard electrode is higher.

(II) Description is now made of the method (II) by separating a case where the developer is charged to negative polarity and a case where the developer is charged to positive polarity.

(i) In a case where the developer is charged to negative polarity

Letting Vs be the average potential of the developer supplying roller and Vu be the average potential of the first electrode, the H level voltage VgH and the L level voltage VgL of the periodic voltage applied to each of the guard electrodes are so set as to satisfy the conditions of Vs<VgH and Vu>VgL. In addition, a state where the L level voltages VgL are respectively applied to two or more continuous guard electrodes and the H level voltages VgH are respectively applied to the other guard electrodes is always maintained, and the guard electrodes to which the L level voltages VgL are respectively applied are shifted one by one toward the inside.

(ii) In a case where the developer is charged to positive polarity

The H level voltage VgH and the L level voltage VgL of the periodic voltage applied to each of the guard electrodes are so set as to satisfy the conditions of Vs>VgH and Vu<VgL. In addition, a state where the H level voltages VgH are respectively applied to two or more continuous guard electrodes and the L level voltages VgL are respectively applied to the other guard electrodes is always maintained, and the guard electrodes to which the H level voltages VgH are respectively applied are shifted one by one toward the inside.

A voltage applied to each of the first electrodes is switched from an OFF voltage to an ON voltage at predetermined time intervals by dynamic scanning control. It is preferable that the period of the periodic voltage applied to the guard electrode is set to an integral fraction of a scanning interval between the first electrodes. Further, an auxiliary electrode having a width equal to the width of the first electrode may be provided between the guard electrode and the first electrodes on the surface of the insulating layer. In this case, a voltage equal to the OFF voltage of the first electrode is always applied to the auxiliary electrode.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Referring to FIGS. 1 to 9, description is now made of embodiments of the present invention.

[1] Description of First Embodiment

Figure 1:
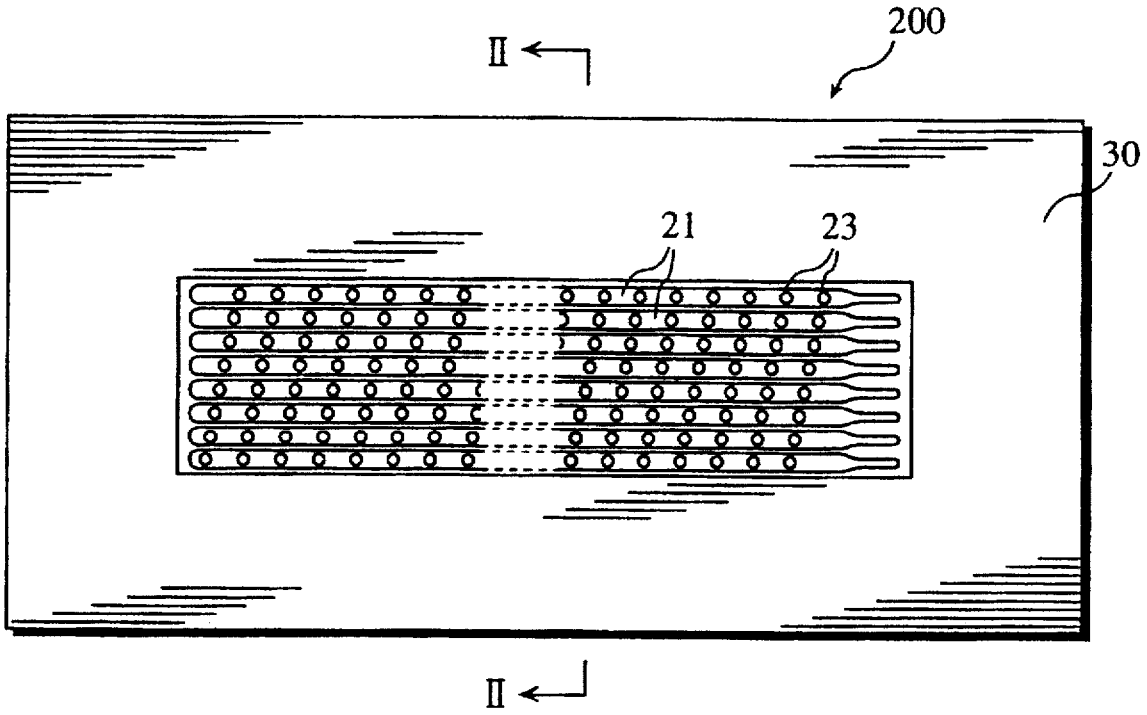
FIG. 1 is a plan view showing a print head according to a first embodiment of the present invention.
Figure 2:
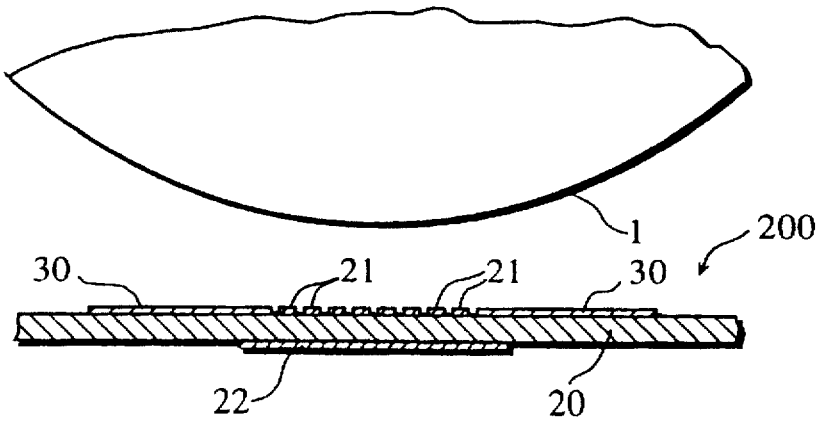
FIG. 2 is a cross-sectional view taken along a line II—II shown in FIG. 1.
Figure 11:
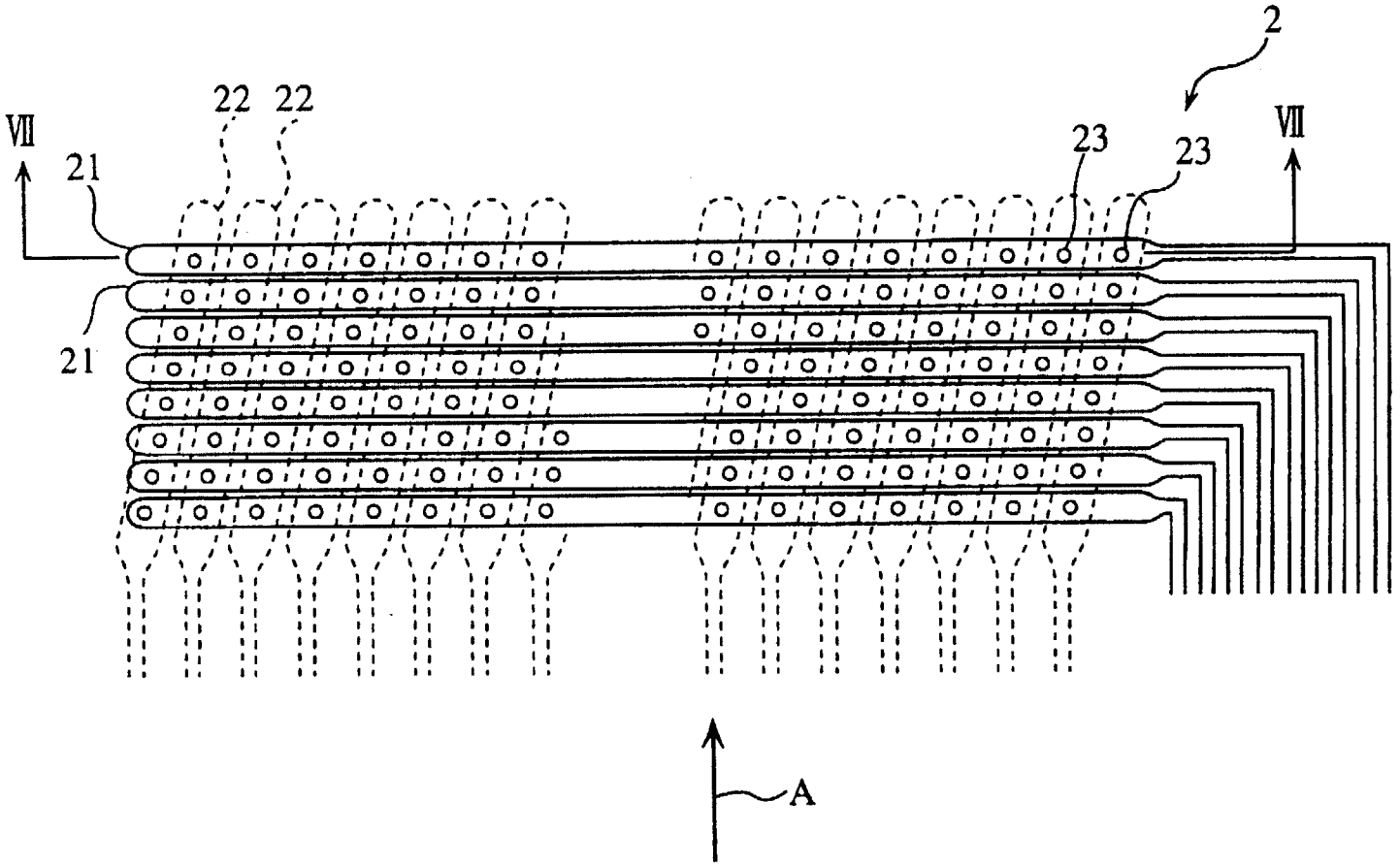
FIG. 11 (PRIOR ART)
FIG. 11 is a plan view showing a conventional print head.
Figure 12:
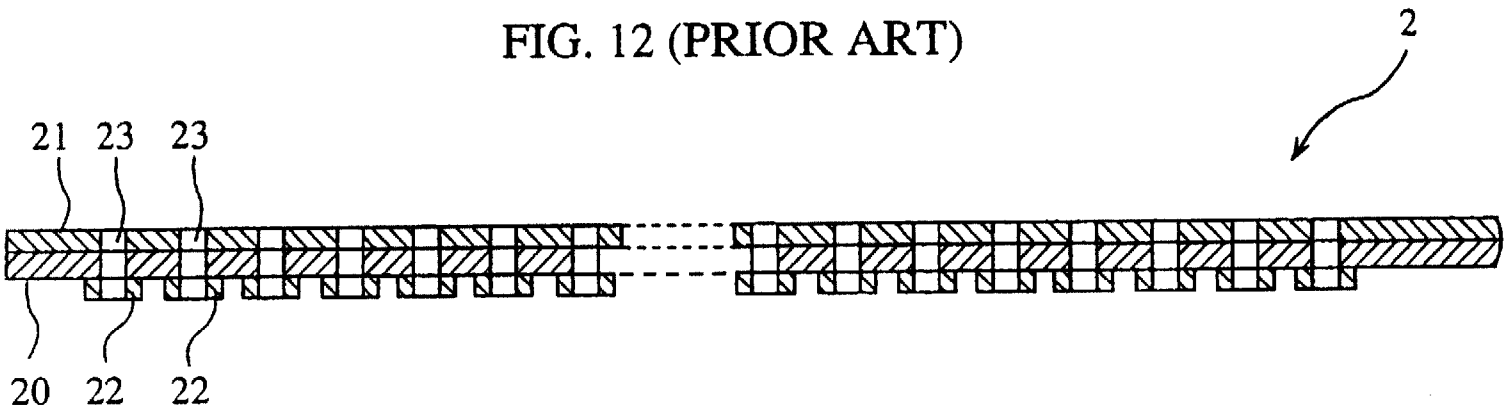
FIG. 12 (PRIOR ART)
FIG. 12 is a cross-sectional view taken along a line XII—XII shown in FIG. 11.

FIGS. 1 and 2 illustrate a print head 200 according to a first embodiment of the present invention. In FIGS. 1 and 2, the same sections as those shown in FIGS. 11 and 12 are assigned the same reference numerals. In this example, toner supplied to the print head 200 shall be charged to negative polarity.

The print head 200 comprises an insulating substrate 20, a plurality of first electrodes 21 formed on the surface of the insulating substrate 20 on the side of a toner supplying roller 1, and a plurality of second electrodes 22 formed on the surface of the insulating substrate 20 on the side of a paper conveying roller 3, similarly to the conventional print head 2 (see FIG. 11). The plurality of first electrodes 21 and the plurality of second electrodes 22 constitute a matrix-shaped electrode. A toner through-hole 23 penetrating the print head 2 is provided at each of intersections of the first electrodes 21 and the second electrodes 22.

Figure 3:
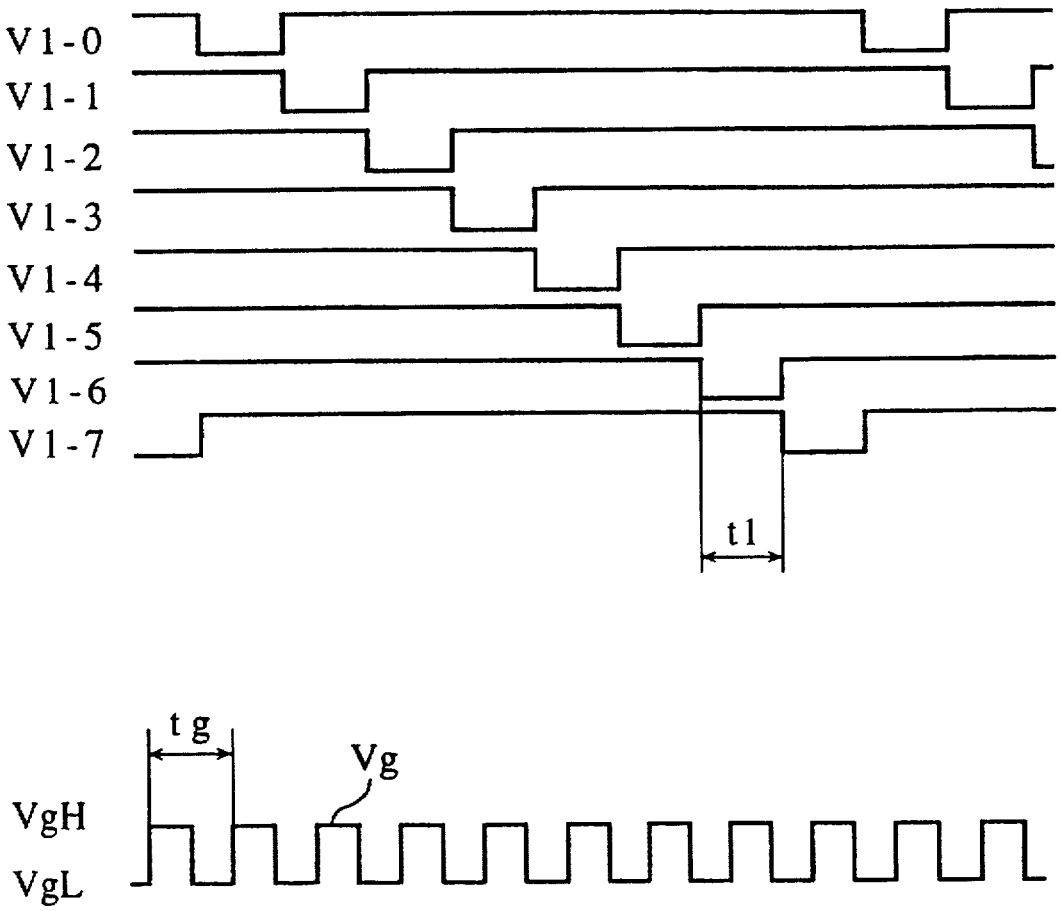
FIG. 3 is a timing chart showing the change of a voltage applied to each of first electrodes and the change of a periodic voltage applied to a guard electrode.

An ON voltage V1L (for example, −100 V) and an OFF voltage V1H (for example, +300 V) are selectively applied to each of the first electrodes 21. An ON voltage (for example, 0 V) and an OFF voltage (for example, −200 V) are selectively applied to each of the second electrodes FIG. 3 illustrates the change of voltages V1–0 to V1–7 applied to the respective first electrodes 21. As shown in FIG. 3, the first electrodes 21 are dynamically scanned, so that the applied voltages are successively turned on at predetermined unit time intervals. Only when the applied voltages of both the first electrode 21 and the second electrode 22 are ON voltages, toner passes through the toner through-hole 23 at the intersection of the first and second electrodes 21 and 22, to do dot printing.

In the print head 200, a guard electrode 30 is formed around the first electrodes 21 on the upper surface of the insulating substrate 20, as shown in FIGS. 1 and 2, unlike that in the conventional print head 2.

A periodic voltage (a pulse voltage) Vg taking two values VgH and VgL as shown in FIG. 3 is applied to the guard electrode 30. Letting Vs (Vs<V1H) be a predetermined voltage applied to the toner supplying roller 1 (the average value of the periodic voltage) and Vu be the average value of the voltage applied to the first electrode 21, the two values (VgH and VgL) of the periodic voltage Vg applied to the guard electrode 30 are so set as to satisfy the conditions as indicated by the following expressions (1) and (2):

$$Vs>VgH \quad (1)$$

$$Vu>VgL \quad (2)$$

The condition as indicated by the foregoing expression (1) is a condition for supplying toner to the guard electrode 30 from the toner supplying roller 1. The condition as indicated by the foregoing expression (2) is a condition for supplying to the first electrode 21 toner drawn to the guard electrode 30.

Furthermore, as shown in FIG. 3, the period tg of the periodic voltage Vg applied to the guard electrode 30 is set to an integral fraction of a scanning interval t1 between the first electrodes 21 (a period elapsed from the time when the voltage of the certain first electrode 21 becomes the ON voltage until the voltage of the succeeding first electrode 21 becomes the ON voltage) {tg=t1/n (n is an integer)}. If the period tg is thus set, the function of an electric field produced by the guard electrode 30 is the same with respect to the first electrodes 21 to which the ON voltages are respectively applied, thereby to make it possible to supply toner to all the first electrodes under the same conditions.

Figure 4A:
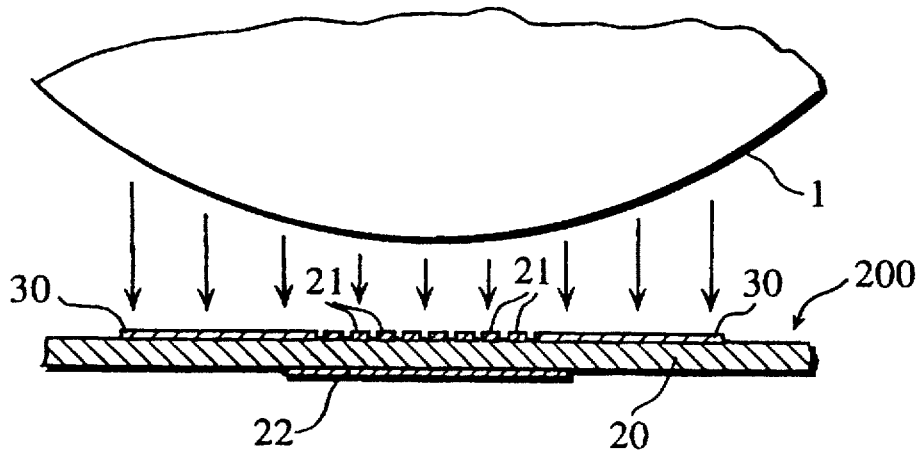
FIGS. 4*a* and 4*b* are cross-sectional views for explaining the function of the guard electrode.

It is assumed that VgL is set to a value lower than Vs. When the periodic voltage Vg applied to the guard electrode 30 is VgH, and the voltage V1 applied to the first electrode 21 is higher than Vs, toner is supplied to the guard electrode 30 from the toner supplying roller 1, and toner is supplied to the first electrode 21 from the toner supplying roller 1, as shown in FIG. 4*a*.

Figure 4B:
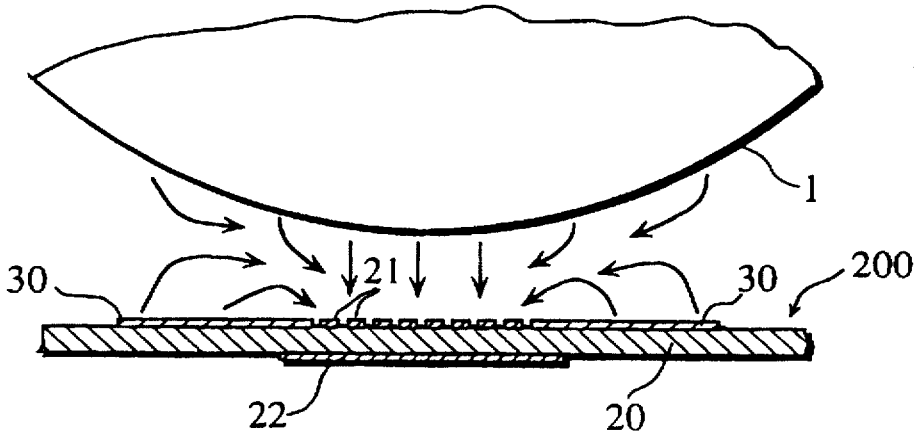

When the periodic voltage applied to the guard electrode 30 is VgL, and the voltage applied to the first electrode 21 is the OFF voltage V1H, toner is supplied to the first electrode 21 from the toner supplying roller 1, and toner drawn to the guard electrode 30 is supplied to the first electrode 21, as shown in FIG. 4*b*. In this case, VgL is lower than Vs, whereby the toner drawn to the guard electrode 30 is drawn to the toner supplying roller 1 and therefore, is easily separated from the guard electrode 30. Accordingly, the toner drawn to the guard electrode 30 is easily supplied to the first electrode 21. Consequently, efficiency in supplying toner to the first electrode 21 becomes higher than that in the conventional print head in which no guard electrode 30 is provided.

[2] Description of Second Embodiment

Figure 5:
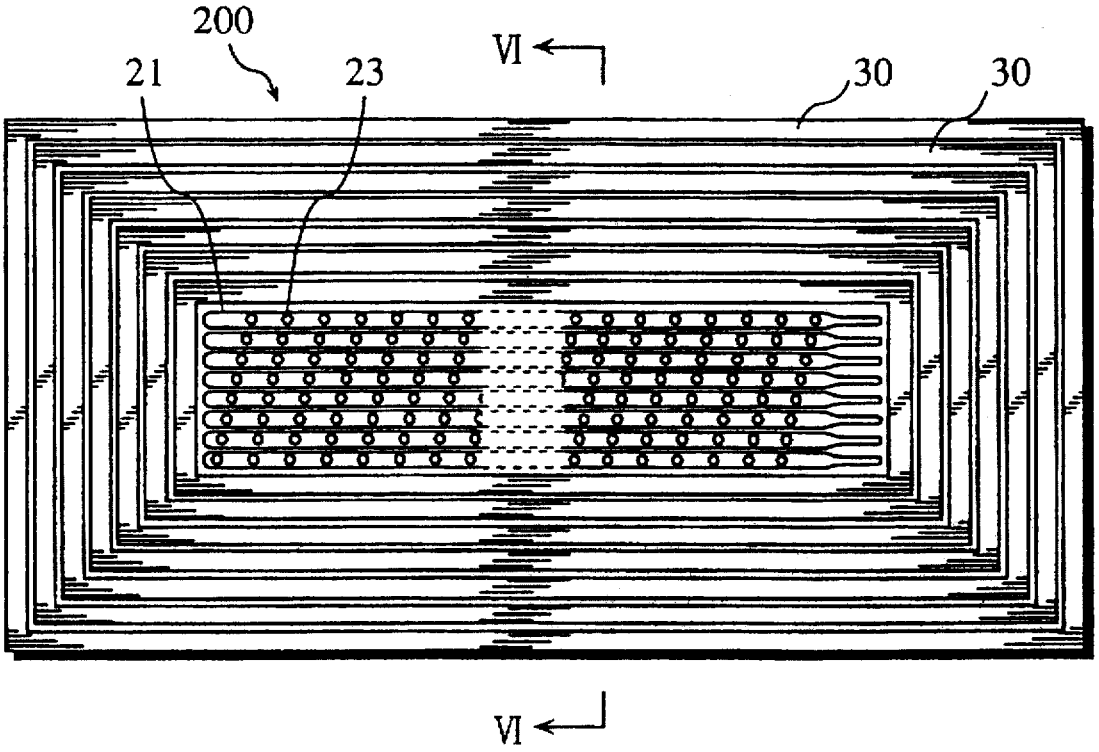
FIG. 5 is a plan view showing a print head according to a second embodiment of the present invention.
Figure 6:
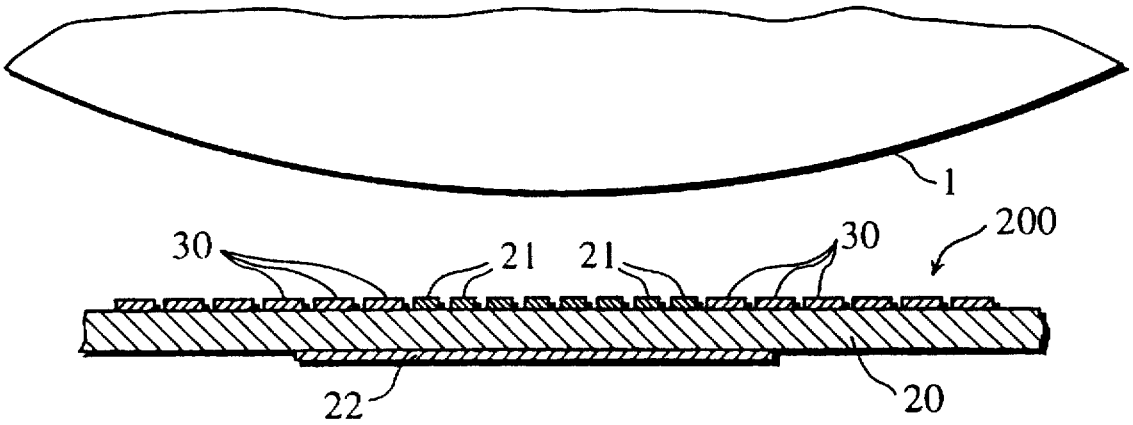
FIG. 6 is a cross-sectional view taken along a line VI—VI shown in FIG. 5.
Figure 7A:
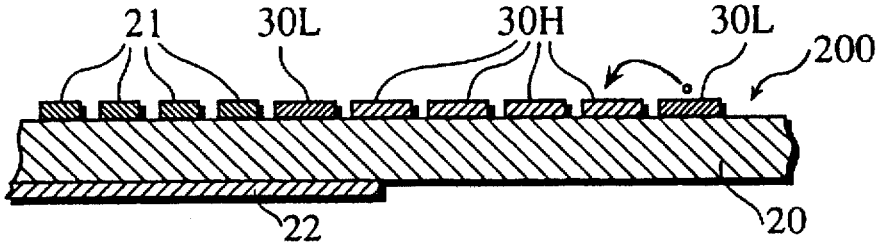
FIGS. 7*a* to 7*f* are timing charts for explaining the timing of switching a periodic voltage applied to each of guard electrodes between an H level voltage and an L level voltage.
Figure 7B:
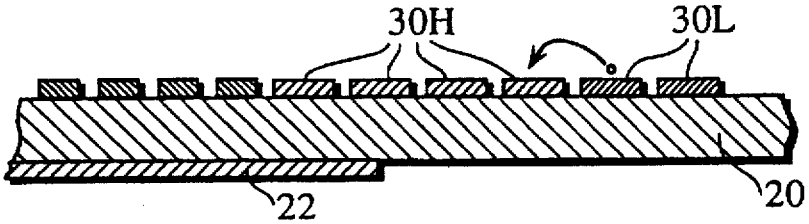
Figure 7C:
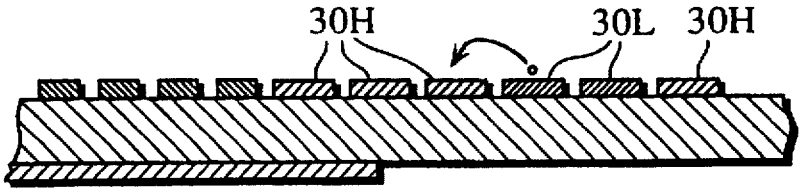
Figure 7D:
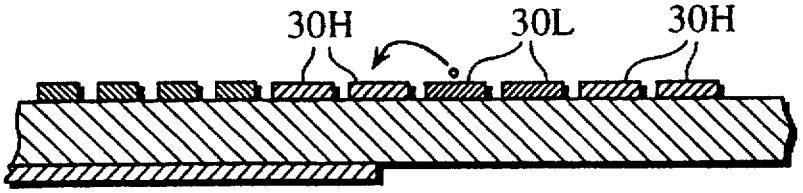
Figure 7E:
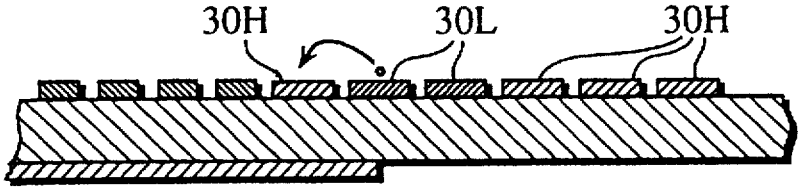
Figure 7F:
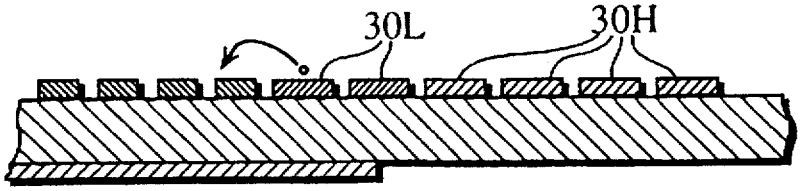

FIGS. 5 and 6 illustrate a print head 200 according to a second embodiment of the present invention.

In this print head 200, a plurality of rectangular frame-shaped guard electrodes 30 are formed with spacing toward the outside around first electrodes 21 on the upper surface of an insulating substrate 20.

Examples of a method of setting a periodic voltage applied to each of the guard electrodes 30 include the following three methods:

(1) First Method

The same periodic voltage satisfying the conditions indicated by the foregoing expressions (1) and (2) is applied to all the guard electrodes 30.

(2) Second Method

The guard electrodes 30 shall be taken as G1, G2, G3 . . . Gn in the order from the innermost guard electrode 30. Two values of periodic voltages respectively applied to the guard electrodes shall be taken as (VG1H, VG1L), (VG2H, VG2L), (VG3H, VG3L) . . . (VGnH, VGnL) in the order from the innermost guard electrode 30.

The timings of switching the periodic voltages respectively applied to the guard electrodes 30 between the two values are the same. In addition, the periodic voltages respectively applied to the guard electrodes 30 are so set as to satisfy the conditions as indicated by the following expressions (3) and (4) in the range in which the conditions indicated by the foregoing expressions (1) and (2) are satisfied:

$$VG1H \leqq VG2H \leqq VG3H \leqq \ldots \leqq VGnH \quad (3)$$

$$VG1L>VG2L>VG3L> \ldots >VGnL \quad (4)$$

According to the condition indicated by the foregoing expression (3), H level voltages of the periodic voltages respectively applied to the adjacent guard electrodes 30 are so set that they are the same or the H level voltage corresponding to the outer guard electrode 30 is higher. The reason for this is that the surface of the toner supplying roller 1 is curved. Specifically, the distance from the toner supplying roller 1 to the outermost guard electrode 30 is the greatest, so that an electric field for supplying toner to the guard electrode 30 from the toner supplying roller 1 becomes weaker. Therefore, an electric field between the guard electrode 30 at a great distance away from the toner supplying roller 1 and the toner supply roller 1 is increased by the condition indicated by the foregoing expression (3).

According to the condition indicated by the foregoing expression (4), L level voltages of the periodic voltages respectively applied to the adjacent guard electrodes 30 are so set that the L level voltage corresponding to the outer guard electrode 30 is lower. The reason for this is that an electric field for supplying toner from the outer guard electrode 30 to the inner guard electrode 30 is produced when the periodic voltage applied to each of the guard electrodes 30 is the L level voltage so that the toner is easily supplied to the first electrodes 21 from all the guard electrodes 30.

(3) Third Method

The periodic voltage applied to each of the guard electrodes 30 is set to a periodic voltage taking two values, that is, an H level voltage VgH and an L level voltage VgL which respectively satisfy the foregoing expressions (1) and (2). The periodic voltages respectively applied to the guard electrodes 30 take the same two values. The timings of switching of the periodic voltages between the H level voltage VgH and the L level voltage VgL are successively shifted toward the inside, as shown in FIG. 7.

FIGS. 7*a* to 7*f* illustrate the timings of switching the periodic voltages respectively applied to the guard electrodes 30 between the H level voltage VgH and the L level voltage VgL. In FIGS. 7*a* to 7*f*, the guard electrode 30 to which the H level voltage VgH is applied out of the guard electrodes 30 is indicated by a symbol 30H, and the guard electrode 30 to which the L level voltage VgL is applied is indicated by a symbol 30L.

In this example, a state where the L level voltages VgL are respectively applied to the adjacent two guard electrodes and the H level voltages VgH are respectively applied to the other guard electrodes is always maintained, and the guard electrodes to which the L level voltages VgL are respectively applied are shifted one by one toward the inside. Consequently, the guard electrodes 30 in the L potential state are shifted one by one toward the inside, and the guard electrode 30 adjacent to and outside of the guard electrode 30 which is changed into the L level voltage becomes the L level voltage.

Toner charged to negative polarity is moved in a direction from an L potential to an H potential. Accordingly, the toner is moved from the outer guard electrode 30 to the inner guard electrode 30 and is supplied to the first electrodes 21 by the above described control of the timing of switching.

[3] Description of Third Embodiment

Figure 8:
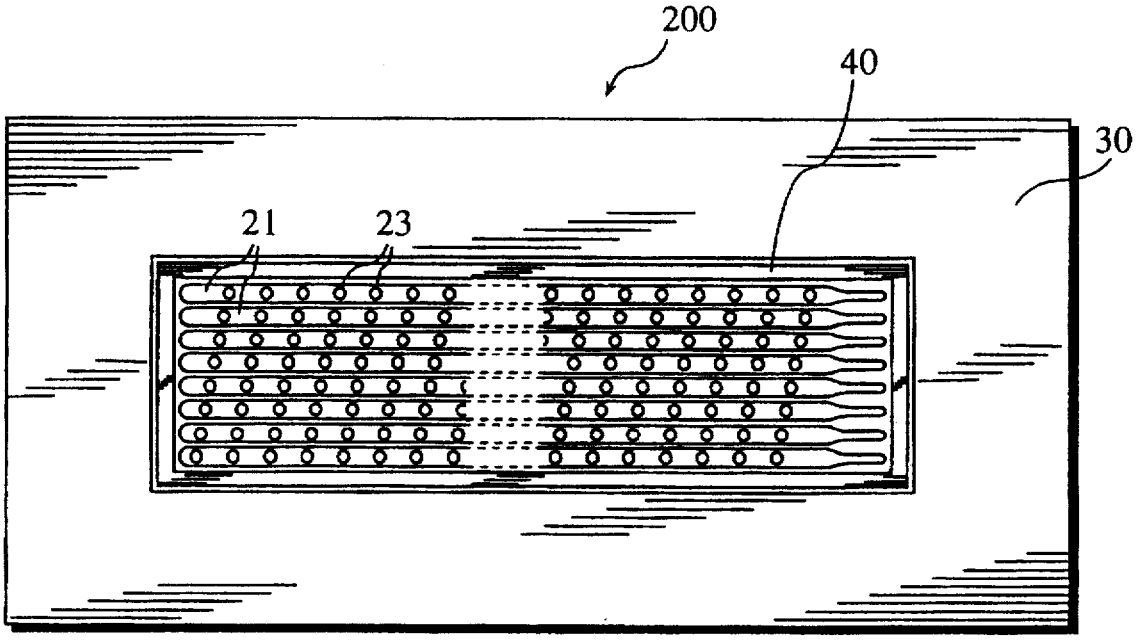
FIG. 8 is a plan view showing a print head according to a third embodiment of the present invention.
Figure 9A:
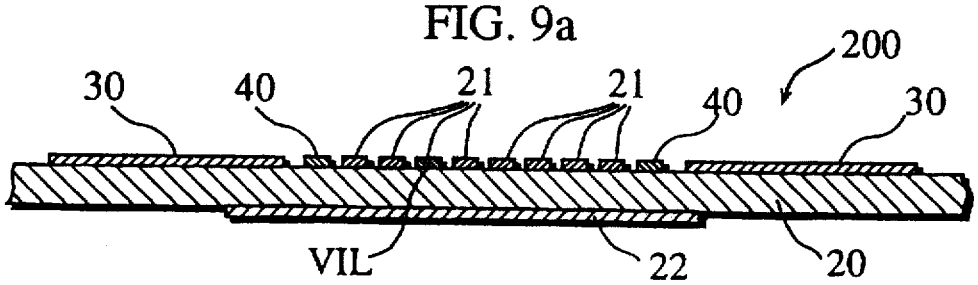
FIGS. 9*a* to 9*d* are timing charts for explaining the function of an auxiliary electrode provided in the print head shown in FIG. 8.
Figure 9B:
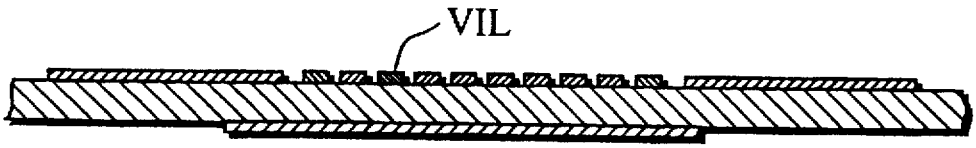
Figure 9C:
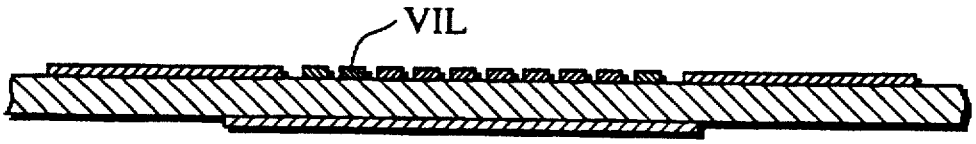
Figure 9D:
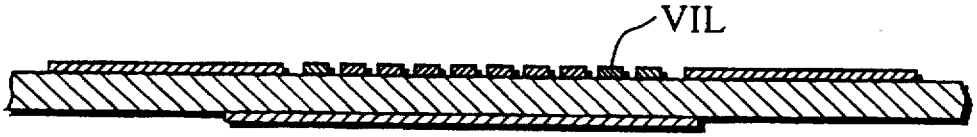
Figure 10:
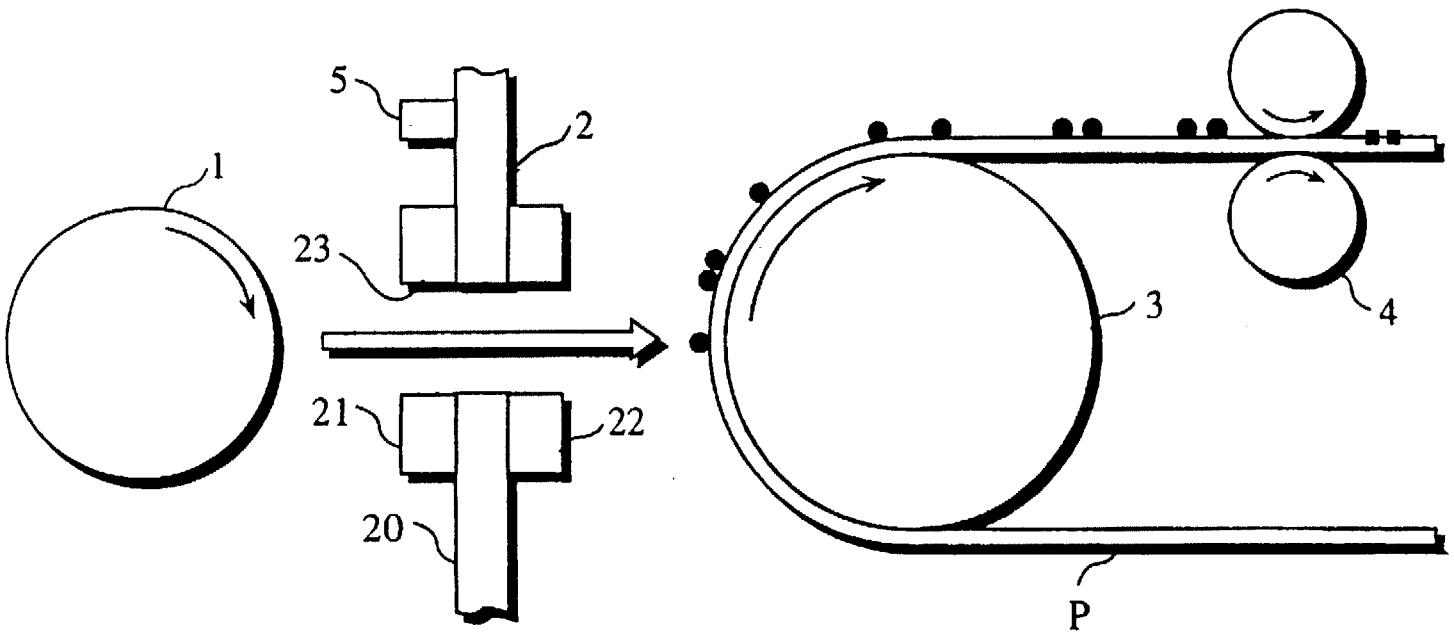
FIG. 10 (PRIOR ART)
FIG. 10 is a diagram showing the schematic construction of a powder jet image forming apparatus.

FIG. 8 illustrates a print head 200 according to a third embodiment of the present invention.

In the print head 200, an auxiliary electrode 40 and a guard electrode 30 arranged outside of the auxiliary electrode 40 are formed around first electrodes 21 on the upper surface of an insulating substrate 20. The width of the auxiliary electrode 40 is made equal to the width of the first electrode 21.

A periodic voltage satisfying the conditions indicated by the foregoing expressions (1) and (2) is applied to the guard electrode 30, as in the first embodiment. A predetermined voltage equal to an OFF voltage V1H of each of the first electrodes 21 is applied to the auxiliary electrode 40. The reason why the auxiliary electrode 40 is provided is as follows.

As shown in FIGS. 9*a* to 9*d*, each of the first electrodes 21 is dynamically scanned. When each of the first electrodes 21 between the first electrodes 21 at both ends becomes an ON voltage V1L, therefore, the first electrodes 21 on both sides thereof become the OFF voltages V1H (see FIGS. 9*a* and 9*b*). On the other hand, when each of the first electrodes 21 at both ends becomes the ON voltage V1L, the first electrode 21 inside thereof becomes the OFF voltage V1H, while the first electrode 21 which becomes the OFF voltage V1H does not exist outside thereof (see FIGS. 9*c* and 9*d*). Therefore, the conditions in a case where each of the first electrodes 21 at both ends becomes the ON voltage V1L differ from the conditions in a case where the other first electrodes 21 become the ON voltages V1L, causing the possibility of non uniformity of the density.

In the present embodiment, the auxiliary electrode 40 is arranged outside of the first electrodes 21 at both ends, and a predetermined voltage equal to the OFF voltage V1H of the first electrode 21 is applied to the auxiliary electrode 40. Even when each of the first electrodes 21 at both ends becomes the ON voltage V1L, therefore, the auxiliary electrode 40 to which the voltage equal to the OFF voltage VH1 of the first electrode 21 exists on both sides thereof. As a result, the respective conditions at the time of the ON voltages of all the first electrodes 21 become the same, thereby to prevent the density from being nonuniform. Also in the present embodiment, a plurality of guard electrodes 30 may be formed.

Description was made of a case where toner is charged to negative polarity, the present invention is also applicable to a case where toner is charged to positive polarity. When toner is charged to positive polarity, signs of inequality in the foregoing expressions (1), (2), (3) and (4) are reversed.

Although the present invention has been described and illustrated in detail, it is Clearly understood that the same is by way of illustration and example only and is not to be taken by way of limitation, the spirit and scope of the present invention being limited only by the terms of the appended claims.

What is claimed is:

1. A print head in a powder jet image forming apparatus comprising a plurality of first electrodes formed on the surface of an insulating layer on the side of a developer supplying roller and a plurality of second electrodes formed on the surface of the insulating layer on the side of a paper conveying section, a developer through-hole being provided at each of intersections of the first electrodes and the second electrodes, wherein one or a plurality of guard electrodes for drawing a developer from the developer supplying roller and supplying the developer to the first electrodes are provided around the first electrodes on the surface of the insulating layer.

2. The print head in the powder jet image forming apparatus according to claim 1, wherein a voltage applied to each of the first electrodes is switched from an OFF voltage to an ON voltage at predetermined time intervals by dynamic scanning control, and the period of a periodic voltage applied to the guard electrode is set to an integral fraction of a scanning interval between the first electrodes.

3. The print head in the powder jet image forming apparatus according to claim 1, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

4. The print head in the powder jet image forming apparatus according to claim 2, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

5. The print head in the powder jet image forming apparatus according to claim 1, wherein a periodic voltage taking two values, that is, an H level voltage VgH and an L level voltage VgL is applied to the guard electrode, the H level voltage VgH and the L level voltage VgL of the periodic voltage applied to the guard electrode are so set as to satisfy, letting Vs be the average potential of the developer supplying roller and Vu be the average potential of the first electrode, the conditions of $Vs<VgH$ and $Vu>VgL$ when the developer is charged to negative polarity, and the H level voltage VgH and the L level voltage VgL of the periodic voltage applied to the guard electrode are so set as to satisfy the conditions of $Vs>VgH$ and $Vu<VgL$ when the developer is charged to positive polarity.

6. The print head in the powder jet image forming apparatus according to claim 5, wherein a voltage applied to each of the first electrodes is switched from an OFF voltage to an ON voltage at predetermined time intervals by dynamic scanning control, and the period of a periodic voltage applied to the guard electrode is set to an integral fraction of a scanning interval between the first electrodes.

7. The print head in the powder jet image forming apparatus according to claim 5, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

8. The print head in the powder jet image forming apparatus according to claim 6, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

9. The print head in the powder jet image forming apparatus according to claim 1, wherein a plurality of guard electrodes are provided with spacing from the inside to the outside around the first electrodes on the surface of the insulating layer, a periodic voltage taking two values, that is, an H level voltage VgH and an L level voltage VgL is applied to each of the guard electrodes, in a case where the developer is charged to negative polarity, the H level voltage VgH and the L level voltage VgL of the periodic voltage applied to each of the guard electrodes are so set as to satisfy, letting Vs be the average potential of the developer supplying roller and Vu be the average potential of the first electrode, the conditions of Vs<VgH and Vu>VgL, the H level voltages VgH of the periodic voltages respectively applied to the adjacent guard electrodes are so set that they are the same or the H level voltage VgH corresponding to the outer guard electrode is higher, and the L level voltages VgL of the periodic voltages respectively applied to the adjacent guard electrodes are so set that the L level voltage VgL corresponding to the outer guard electrode is lower, and in a case where the developer is charged to positive polarity, the H level voltage VgH and the L level voltage VgL of the periodic voltage applied to each of the guard electrodes are so set as to satisfy the conditions of Vs>VgH and Vu<VgL, the H level voltages VgH of the periodic voltages respectively applied to the adjacent guard electrodes are so set that they are the same or the H level voltage VgH corresponding to the outer guard electrode is lower, and the L level voltages VgL of the periodic voltages respectively applied to the adjacent guard electrodes are so set that the L level voltage VgL corresponding to the outer guard electrode is higher.

10. The print head in the powder jet image forming apparatus according to claim 9, wherein a voltage applied to each of the first electrodes is switched from an OFF voltage to an ON voltage at predetermined time intervals by dynamic scanning control, and the period of the periodic voltage applied to each of the guard electrodes is set to an integral fraction of a scanning interval between the first electrodes.

11. The print head in the powder jet image forming apparatus according to claim 9, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

12. The print head in the powder jet image forming apparatus according to claim 10, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

13. The print head in the powder jet image forming apparatus according to claim 1, wherein a plurality of guard electrodes are provided with spacing from the inside to the outside around the first electrodes on the surface of the insulating layer, a periodic voltage taking two values, that is, an H level voltage VgH and an L level voltage VgL is applied to each of the guard electrodes, in a case where the developer is charged to negative polarity, the H level voltage VgH and the L level voltage VgL of the periodic voltage applied to each of the guard electrodes are so set as to satisfy, letting Vs be the average potential of the developer supplying roller and Vu be the average potential of the first electrode, the conditions of Vs<VgH and Vu>VgL, a state where the L level voltages VgL are respectively applied to two or more continuous guard electrodes and the H level voltages VgH are respectively applied to the other guard electrodes is always maintained, and the guard electrodes to which the L level voltages VgL are respectively applied are shifted one by one toward the inside, and in a case where the developer is charged to positive polarity, the H level voltage VgH and the L level voltage VgL of the periodic voltage applied to each of the guard electrodes are so set as to satisfy the conditions of Vs>VgH and Vu<VgL, and a state where the H level voltages VgH are respectively applied to two or more continuous guard electrodes and the L level voltages VgL are respectively applied to the other guard electrodes is always maintained, and the guard electrodes to which the H level voltages VgH are respectively applied are shifted one by one toward the inside.

14. The print head in the powder jet image forming apparatus according to claim 13, wherein a voltage applied to each of the first electrodes is switched from an OFF voltage to an ON voltage at predetermined time intervals by dynamic scanning control, and the period of the periodic voltage applied to each of the guard electrodes is set to an integral fraction of a scanning interval between the first electrodes.

15. The print head in the powder jet image forming apparatus according to claim 13, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

16. The print head in the powder jet image forming apparatus according to claim 14, wherein a voltage applied to each of the first electrodes is switched from an OFF voltage to an ON voltage at predetermined time intervals by dynamic scanning control, an auxiliary electrode having a width equal to the width of the first electrode is provided between the guard electrode and the first electrodes on the surface of the insulating layer, and a voltage equal to the OFF voltage of the first electrode is always applied to the auxiliary electrode.

* * * * *